US009833803B2

(12) United States Patent
Hart

(10) Patent No.: US 9,833,803 B2
(45) Date of Patent: Dec. 5, 2017

(54) APPARATUS AND METHOD FOR SANITIZING

(71) Applicant: David Hart, Bend, OR (US)

(72) Inventor: David Hart, Bend, OR (US)

( * ) Notice: Subject to any disclaimer, the term of this patent is extended or adjusted under 35 U.S.C. 154(b) by 351 days.

(21) Appl. No.: 14/706,018

(22) Filed: May 7, 2015

(65) Prior Publication Data

US 2015/0328350 A1 Nov. 19, 2015

Related U.S. Application Data

(60) Provisional application No. 61/993,305, filed on May 15, 2014.

(51) Int. Cl.
*B05B 1/04* (2006.01)
*B05B 7/24* (2006.01)
(Continued)

(52) U.S. Cl.
CPC ..... *B05B 13/0627* (2013.01); *B05B 1/046* (2013.01); *B05B 1/267* (2013.01);
(Continued)

(58) Field of Classification Search
CPC ..... B05B 1/046; B05B 1/267; B05B 7/1606; B05B 7/2405; B05B 7/2416; B05B 7/2489; B05B 13/0627; A61L 2/22
(Continued)

(56) References Cited

U.S. PATENT DOCUMENTS 1,988,979 A * 1/1935 Campbell ..... A61C 17/02 128/200.23
2,735,794 A * 2/1956 Pletcher ..... A23G 9/30 134/102.1

(Continued)

*Primary Examiner* — Ryan A Reis
(74) *Attorney, Agent, or Firm* — Hancock Hughey LLP

(57) ABSTRACT

An apparatus and system that efficiently and effectively delivers a sanitizing fluid to ducts in the form of a fog or mist is described. A canister that contains a liquid sanitizing solution is attached to a compressor and includes a straw that has an internal passageway that extends into the liquid and a venturi tube above the level of the liquid that connects with the internal passageway in the straw. The headspace above the liquid in the canister is pressurized, causing fluid to flow upwardly in the straw when a trigger is depressed, drawing fluid upwardly in part by the venturi. As the liquid passes the venturi the pressurized air that is flowing into the venturi causes the fluid to form a fine mist. The mist, under pressure from the compressor, is routed into a flexible delivery tube that has been previously positioned in a duct system. The terminal end of the tube has an atomizing ball attached thereto and the atomizing ball has a series of orifices through which the misted, atomized fluid is delivered. As fogged sanitizing solution flows through the orifices it is deposited on the interior surfaces of the duct. The delivery tube and the attached atomizing ball are withdrawn from the duct as the sanitizing fog is emitted from the ball. The fan in the HVAC system is not activated so there is no deliver of the sanitizer through registers and into the living space. The apparatus and method may be used to apply other fluids to other surfaces.

20 Claims, 6 Drawing Sheets

(51) Int. Cl.
*B05B 13/06* (2006.01)
*B05B 1/26* (2006.01)
*B05B 7/16* (2006.01)

(52) U.S. Cl.
CPC ..... *B05B 7/1606* (2013.01); *B05B 7/2405* (2013.01); *B05B 7/2416* (2013.01); *B05B 7/2489* (2013.01)

(58) Field of Classification Search
USPC ..... 239/346, 364, 368, 526, 559, 567
See application file for complete search history.

(56) References Cited

U.S. PATENT DOCUMENTS 3,031,148 A * 4/1962 Holdren ..... B05B 1/14 134/166 R
3,079,937 A * 3/1963 Tooper ..... B05B 15/061 134/166 R
4,471,911 A * 9/1984 Hengesbach ..... B05B 1/32 222/325
4,841,999 A * 6/1989 Danko ..... B08B 15/026 134/123
5,271,564 A * 12/1993 Smith ..... B05B 7/0081 239/290
5,383,975 A * 1/1995 Faxon ..... B08B 9/0495 134/167 C
5,813,089 A * 9/1998 Nolan ..... A46B 13/02 134/167 C
6,189,622 B1 * 2/2001 Audet ..... A62C 31/02 169/16
6,199,566 B1 * 3/2001 Gazewood ..... B08B 9/0433 134/166 C
7,426,768 B2 * 9/2008 Peterson ..... B08B 9/045 15/304
7,793,964 B2 * 9/2010 Christensen ..... B60P 3/40 280/404

* cited by examiner

APPARATUS AND METHOD FOR SANITIZING

TECHNICAL FIELD

The present invention relates to an apparatus and method for applying fluid such as sanitizing fluid to ducts and the like, and more specifically to an apparatus that delivers a sanitizing solution in the form of a fog or mist to the interior of ducts such as those in HVAC systems.

BACKGROUND

Ducts such as those found in HVAC systems in both commercial and residential settings often require cleaning. There are several known and well-established ways to clean ducts, for example, vacuum systems, rotating brushes to air-jet systems, and combinations of these. Described briefly, a cleaning system is intended to remove dust and debris from the interior of ductwork so that these materials are not blown into the structure by the fans that move air, both heated and cooled, through the ducts. As would be expected, ducts are a collection point for all sorts of detritus, everything from dust, mold and mildew to rodents and their droppings. Maintaining ducts in a clean state is very important to prevent detritus from the ducts being blown into the structures that the ducts supply hot and cold air to. This is especially true as the incidence of health problems associated with airborne particulate matter, such as various forms of asthma, seem to be on the increase.

As would also be expected, especially in view of the fact that ducts can be infested with rodents, sanitizing ducts after they have been cleaned can be an important maintenance procedure. Conventionally, sanitizing is accomplished by introducing a mist of a sanitizing solution into the cold air return vent of a ducting system while the fan (such as a furnace fan) is operating. The fan draws/pushes the mist through the ducts and the sanitizing solution is thus deposited on the interior surfaces of the ducts. But a drawback of this technique is that for the fan to draw/push the sanitizing mist through the entire system, the registers through which air is delivered into the living spaces must be left open. As a result, most of the sanitizing mist is pushed into the living space where it collects on surfaces. This can be a detriment in a variety of ways, from off odors to health issues.

There is a need therefore for an apparatus and methods for sanitizing ductwork.

The invention described herein and illustrated in the drawings defines an apparatus and system that efficiently and effectively delivers a sanitizing compound to ducts while avoiding problems associated with known systems. While the invention is described an illustrated in a preferred embodiment with respect to applying sanitizing fluid to HVAC ducts and the like, it will be appreciated that the principles of the invention and the components may be used to apply other liquids to other surfaces. As such the invention is not limited to sanitizing fluid applied to ductwork but is limited only by the appended claims.

The present invention is defined by a canister that contains a liquid sanitizing solution and which includes a trigger. The canister is attached to a compressor and includes a straw that has an internal passageway that extends into the liquid and a venturi tube above the level of the liquid that connects with the internal passageway in the straw. When the trigger is actuated, the headspace above the liquid in the canister is pressurized, causing fluid to flow upwardly in the straw, drawing upwardly in part by the venturi. As the liquid passes the venturi the pressurized air flat is flowing into the venturi causes the fluid to form a fine mist. The mist, under pressure from the compressor, is routed into a flexible delivery tube that has been previously positioned in a duct system. The terminal end of the tube has an atomizing ball, also called a misting ball, attached thereto and the atomizing ball has a series of purposefully and specifically oriented orifices through which the misted, atomized fluid is delivered. As fogged or misted sanitizing solution flows through the orifices it is deposited on the interior surfaces of the duct. The delivery tube and the attached atomizing ball are withdrawn from the duct as the sanitizing fog is emitted from the ball. The fan in the HVAC system is not activated so there is no deliver of the sanitizer through registers and into the living space.

BRIEF DESCRIPTION OF THE DRAWINGS

The invention will be better understood and its numerous objects and advantages will be apparent by reference to the following detailed description of the invention when taken in conjunction with the following drawings.

FIG. 3 shows the canister with its trigger head assembly separated from the canister, and the atomizing ball.

DETAILED DESCRIPTION OF PREFERRED EMBODIMENTS

The invention and its method of use will now be described in detail with reference to the drawings. It will be understood that relative directional terms are used at times to describe components of the invention and relative positions of the components. As a naming convention, the ground plane or the plane of a floor in a structure is considered to be a generally horizontal surface. Other relative directional terms correspond to this convention: "upper" refers to the direction above and away from the floor plane; "lower" is generally in the opposite direction, "inward" is the direction from the exterior toward the interior of the apparatus, "vertical" is the direction normal to the horizontal floor plane, and so on.

Figure 1:
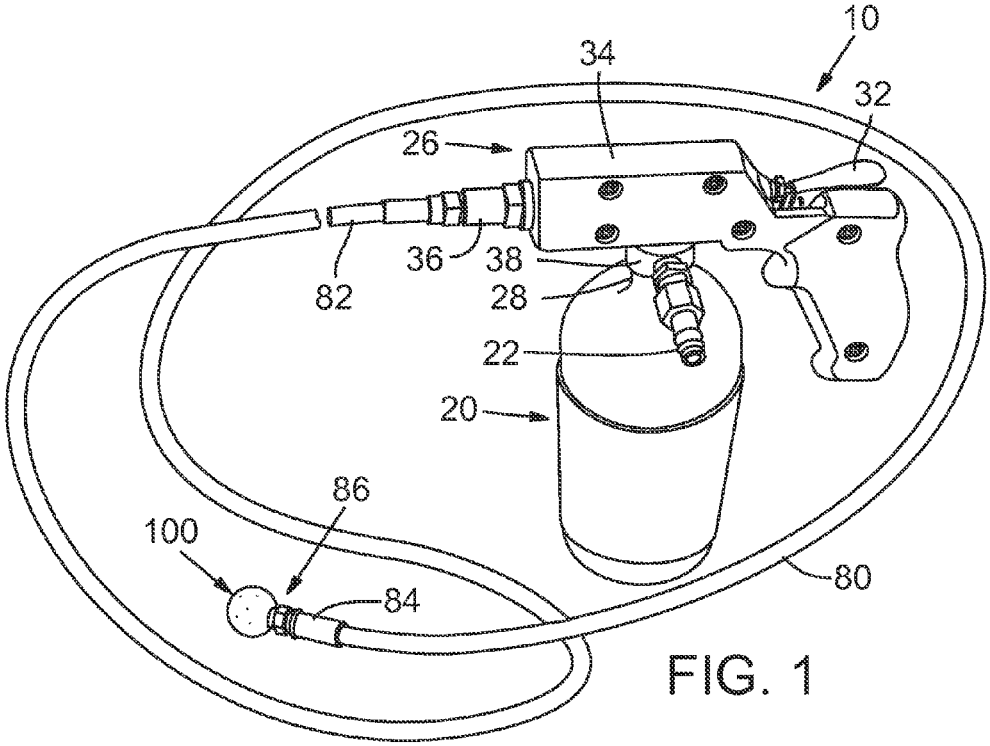
FIG. 1 is a perspective view of a complete apparatus according to the present invention for sanitizing ducts.

With reference now to FIG. 1, apparatus 10 according to a first illustrated embodiment comprises three primary components: a canister 20, a delivery tube 80 and an atomizing ball 100. Each of these basic components is shown in the various drawings and will be described in detail, both structurally and functionally, below.

Canister 20 is shown in detail in FIGS. 1 through 4. It includes a quick connect fitting 22 that is a conventional pressure fitting for connecting the canister to a conventional air compressor and which defines a port for compressed air from the air compressor to pressurize the canister. The air compressor and the tubing that connects it to the canister 20 at quick connect fitting 22 are not shown in the drawings because they are entirely conventional and form no part of the invention. And while the quick connect fitting 22 shown in FIG. 1 extends away from the canister 20 at approximately a right angle relative to a vertical axis, it will be appreciated that the quick connect may be oriented at an angle, such as a 45 degree downward angle, to make the connection to the compressor easier from an ergonomic perspective. Nominally, the air compressor is operated at a pressure sufficient to generate a fine mist or to atomize the sanitizing fluid. As used herein, the terms "mist" and "atomized" fluid refer to a fluid that in the form of fine, small droplets. In operation, 200 psi is sufficient. Of course, all components in the system that are pressurized must be specified for safe operation at normal operating pressures.

Figure 2:
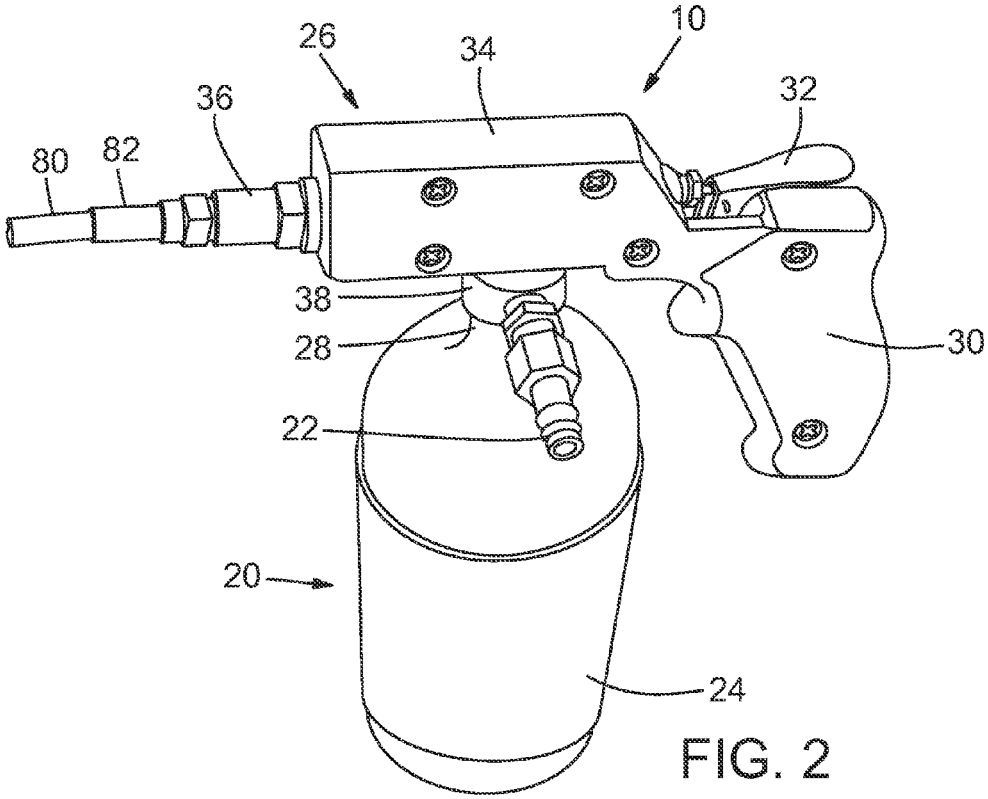
FIG. 2 is perspective view of an exemplary embodiment of a canister for use with the apparatus shown in FIG. 1.

Canister 20 is shown in isolation in FIG. 2. The canister 20 comprises a bottle 24 that defines a reservoir for containing a supply of liquid sanitizing solution. A trigger head assembly 26 is threaded onto the threaded opening 28 at the upper end of bottle 24 and includes a handle 30, a trigger 32, a head 34 and an outlet connection 36. The delivery tube 80 (described below) connects to the outlet connection 36 of the trigger head assembly 26 to the atomizing ball 100 and provides a fluid pathway from the bottle 24 to the atomizing ball. The connection illustrated in FIG. 2 between delivery tube 80 and outlet connection 36 is a threaded connection, but a quick connect fitting such as quick connect 22 used on canister 20 may be substituted.

Figure 3:
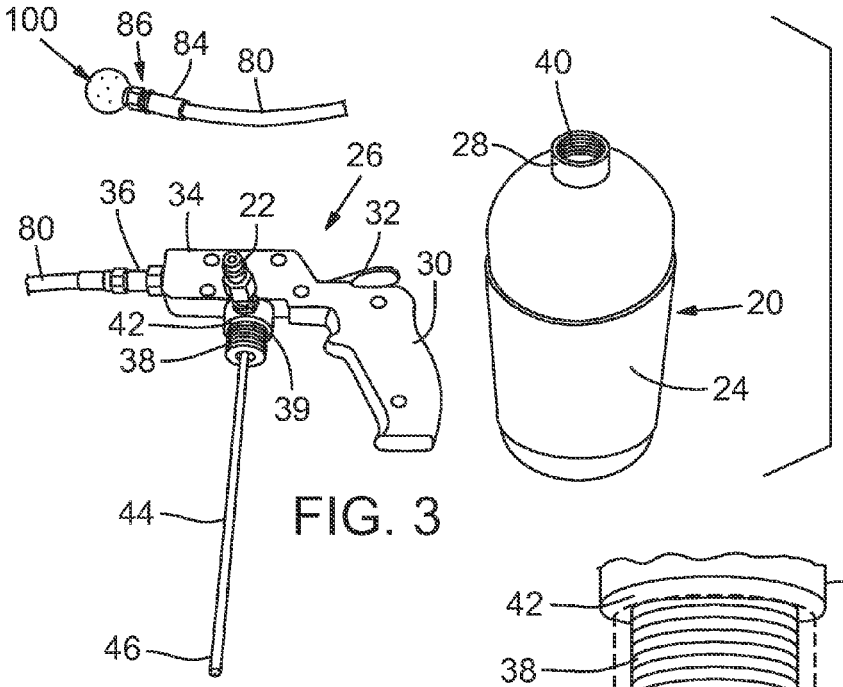
FIG. 3 is a perspective view of three primary components of the apparatus according to the present invention shown in FIG. 1, and more specifically.

FIG. 3 shows the canister 20 and its component parts in a disassembled view, namely, where the trigger head assembly 26 and delivery tube 18 are shown in isolation. Trigger head assembly 26 has a threaded boss 38 that threads into threaded opening 40 in the upper end of bottle 24. An O-ring 42 on a shoulder 39 of boss 38 provides a fluid tight seal between trigger head assembly 26 and bottle 24 when the trigger head assembly 26 is threaded into bottle 24 and canister 20 is pressurized by the air compressor. A straw 44 extends downwardly from trigger head assembly 26 and through boss 38. As detailed below, the distal end 46 of straw 44 is immersed in the sanitizing fluid contained in bottle 24 during operation of apparatus 10 and the fluid is pushed/drawn upwardly through a passageway through the straw for delivery into the delivery tube 80.

Figure 4:
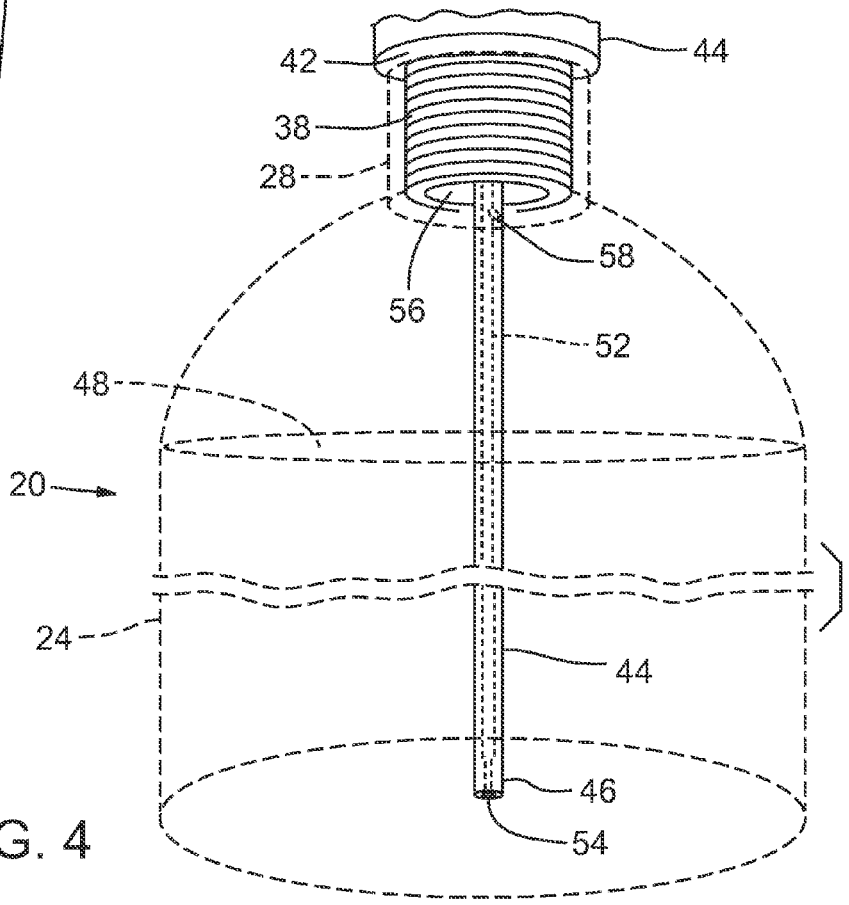
FIG. 4 is a perspective view of part of the canister shown in FIG. 2 and illustrating in phantom lines the interior components of the apparatus, and more particularly, the straw that is part of the trigger head assembly.

Reference is now made to FIG. 4, which is a partial schematic representation of bottle 24 to illustrate better the straw 44. In FIG. 4, the dashed line 48 represents the level of sanitizing fluid contained in the bottle 24 when the bottle is in a full condition. The distal end 46 of straw 44 is below the headspace 50 defined as the air space over the fluid level, dashed line 48. A fluid passageway 52 extends completely through straw 44 from the inlet 54 at distal end 46 and extending through the straw at its connection at the proximate end 56, which is connected to a fluid passageway within head 34. The nominal diameter of fluid passageway 52 is approximately 9 mm. Above the fluid level 48, in headspace 59, is a venturi tube 58 that defines a passageway from the outer wall of straw 44 that connects to fluid passageway 52. Ideally, venturi tube 58 is angled downwardly relative to passageway 52 at about a 45 degree angle, as shown. The nominal diameter of venturi tube 58 is about 9 mm.

The proximate end 56 of straw 44 is connected to an internal fluid passageway (not shown) in head 34 that fluidly communicates with outlet 36. Trigger 32 is operable to open and close the fluid passageway and to vary the degree of openness of the passageway.

With returning reference to FIG. 1, the delivery tube 80 defines a fluid passageway extending from the trigger head assembly 26 to the atomizing ball 100. More specifically, pressurized and at least partially atomized fluid flows through delivery tube 80 when the canister 20 is pressurized and trigger 32 is actuated to open the fluid passageway through trigger head assembly 26 and to thereby cause a flow of fluid to move through the apparatus. The proximate end 82 of delivery tube 80 is attached to outlet 36 of trigger head assembly 26, as noted above with a quick connect fitting or with a screw fitting as shown in the figures. The distal, terminal end 84 of delivery tube 80 is attached to atomizing ball 100. The attachment of tube 80 to ball 100 may be in any appropriate manner, for example, with a threaded connection shown generally at reference number 86. The material used for delivery tube 80 is preferably flexible so that the tube and the attached atomizing ball may be easily maneuvered through the various turns found in common ducting systems. The tube preferably has sufficient longitudinal rigidity that it may be pushed into a duct, as detailed below. A suitable hose is a polyurethane reinforced type of tube, and of course the tube must be of the type that is capable of being used at the operating pressures for the apparatus. The length of tube 80 will vary on the particular use, but is preferably long enough that the tube is able to reach from the introduction point of the tube in the duct system to the furthest most point that is to be sanitized, as detailed below.

Figure 5:
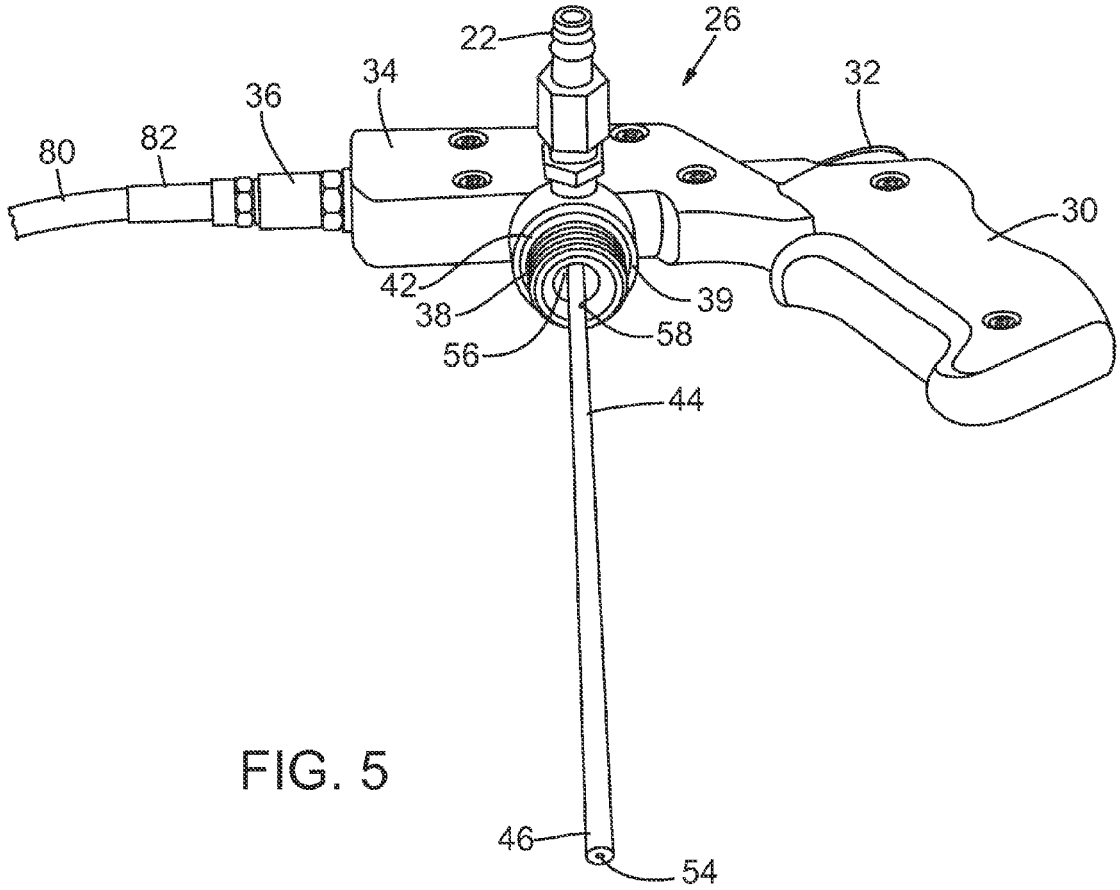
FIG. 5 is a perspective view of the trigger head assembly shown in isolation.

FIG. 5 is a relative close up view of the distal end of the straw 44, showing inlet 54, and also illustrating and the attachment of the proximal end 56 of straw 44 to the trigger head assembly 26.

Figure 6:
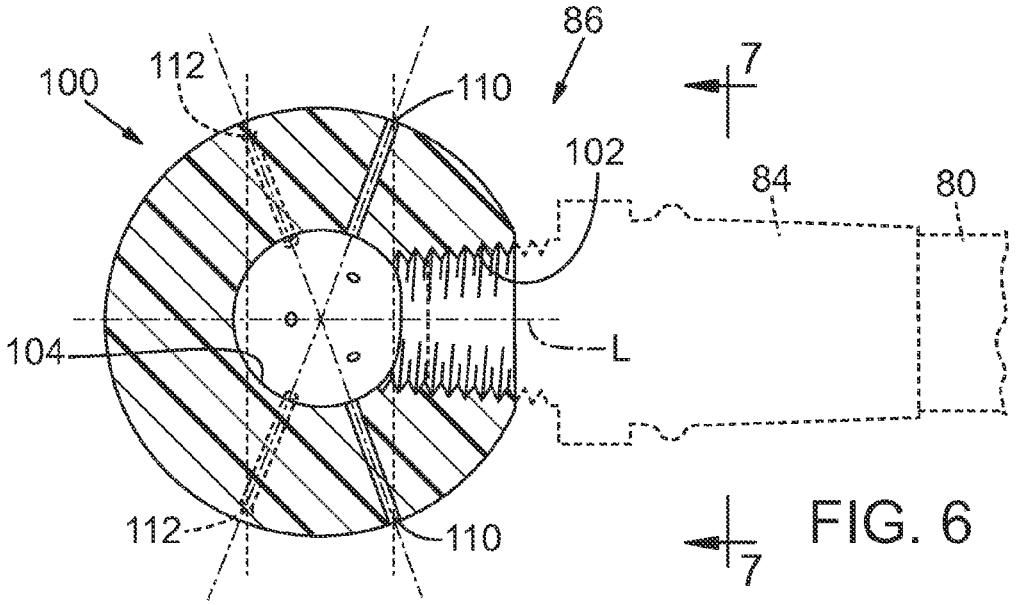
FIG. 6 is a cross sectional view of one preferred embodiment of an atomizing ball according to the present invention.

FIG. 6 is a cross sectional view through one preferred embodiment of atomizing ball 100. An inlet 102 in ball 100 is threaded. The distal end 84 of delivery tube 80 threads into the threaded inlet 102, as noted above with a threaded fitting 86. The diameter of inlet 102 is nominally ⅛ inch, although this may be varied. The inlet 102 defines a chamber 104 in ball 100 that preferably has the same diameter as inlet 102 and into which sanitizing fluid is delivered under pressure from delivery tube 80. There are plural outlets formed in atomizing ball 100 that communicate with chamber 104 and which define outlet orifices so that fluid flowing into the chamber 104 is ejected through the orifices. The outlet orifices have a smaller diameter than the inlet 102 and chamber 104. The outlets define fluid pathways from the inlet 102 and chamber 104 so that fluid flowing into the chamber may be ejected under pressure from the atomizing ball 100. The number, arrangement, angular orientation and spacing of the outlets may be varied; those shown in FIG. 6 are exemplary but not limiting. As seen in FIG. 6, there six outlets labelled with reference number 110, and six outlets labelled with reference number 112. The outlets 110 are relatively evenly radially spaced around the outer surface of ball 100 and are angularly oriented relative to the longitudinal axis L defined by inlet 102. More particularly, the six outlets 110 are angled in the direction back toward the point where delivery tube 80 is attached to inlet 102. The angular displacement of the outlets 110 is preferably between about 20 and 45 degrees from a line normal to the longitudinal axis L, but the angle may vary according to need. The six outlets labelled with reference number 112 also extend at an angle relative to the longitudinal axis L defined by inlet 102, and most preferably, at an angle between about 20 and 45 degrees. However, as shown in FIG. 6, the outlets 112 are angled in the opposite direction of the outlets 110, toward the forward end of ball 100.

Figure 7:
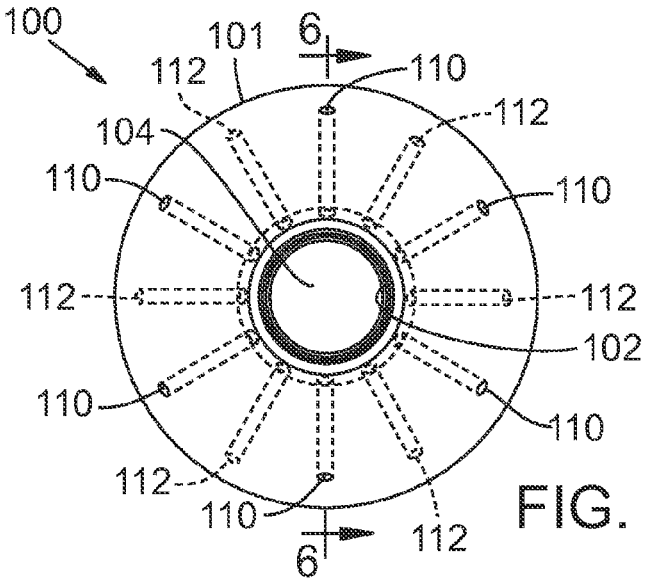
FIG. 7 is an elevation view taken along the line 7-7 of FIG. 6.

Turning now to FIG. 7, which is a view taken along the line 7-7 of FIG. 6, there twelve separate outlet orifices 110 and 112 arranged at equal radial intervals around inlet 102, and the six outlets 110 are radially staggered relative to the six outlets 112. The twelve outlet orifices are equally spaced around the inlet 102 in an annular array, meaning that there is an arc of about 60 degrees between adjacent orifices 110 and the same arc between adjacent orifices 112. The number of outlet orifices and their spacing and angular orientation relative to the axis of inlet 102 may be varied widely.

Ball 101 is preferably made from a durable plastic or similar material such as nylon.

Figure 8:
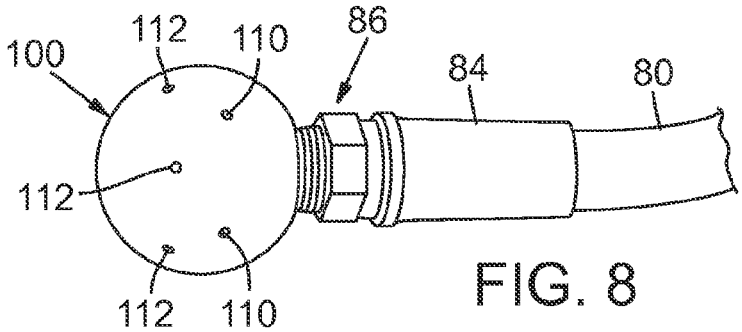
FIG. 8 is a perspective view of the atomizing ball shown in FIGS. 6 and 7.

FIG. 8 is one embodiment of an atomizing ball 100 attached to a delivery tube 80 with a threaded fitting 86.

Figure 9:
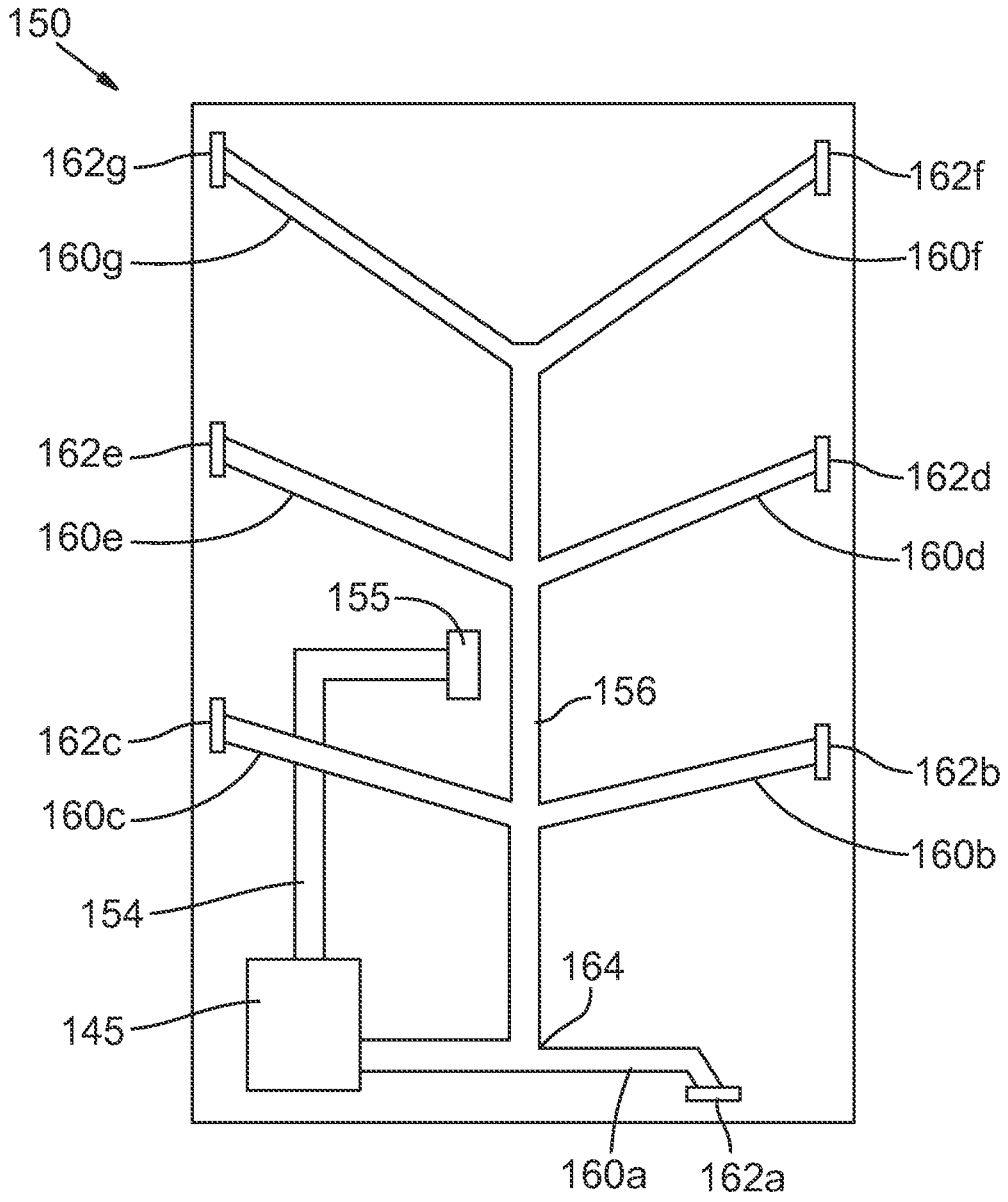
FIG. 9 is a schematic plan view of a representation of a floor plan of a house or other structure that utilizes a HVAC of the type that may be sanitized with the apparatus according to the present invention.

Operation of apparatus 10 will now be detailed with particular reference to the schematic drawing of FIG. 9, which is a representation of a floor plan of a structure that utilizes an HVAC system. Specifically, with reference to FIG. 9, the structure's foundation perimeter is shown at 150. An air-moving apparatus 145, such as a furnace, heat pump and the like is a conventional HVAC unit that includes a fan (not shown) and which includes a cold air return 154 that has a conventional in-structure cold air return vent 155. The main duct line 156 extends from the furnace 145 and includes plural branch ducts that each terminates in a register. Specifically, the branch ducts are labelled with reference numbers 160*a*, 160*b*, 160*c*, 160*d*, 160*e*, 160*f*, and 160*g*. Each of these branch ducts terminates at a register; the registers are labelled to correspond with the labeling convention used for the branch ducts, thus, 162*a*, 162*b*, 162*c*, 162*d*, 162*e*, 162*f*, and 162*g*.

In order to sanitize the branch ducts 160 and the main duct 156, sanitizing fluid is filled into canister 20 to the level shown in FIG. 4 and identified with reference number 48. With delivery tube 80 disconnected from canister 20 at outlet 36, the atomizing ball 100 is inserted into a register opening (the register grate is removed first) and the ball and tube 80 are threaded into the branch duct a few feet. For example, with reference to FIG. 9, the sanitizing operation could begin at register 162*f*. The register grate is removed and the ball 100 with attached tube 80 is inserted through the register opening and into branch duct 160*f*. The ball 100 and tube 80 may be inserted into a duct such as duct 160*f* in several different ways. In a first preferred method the operator simply snakes the ball and tube into the ducting system by pushing on the tube, which is flexible but axially and longitudinally rigid enough that it may be slid into the duct fairly easily. Another method involves use of attaching the proximate end of the tube 80 to an air compressor and using air blown through the outlet orifices in ball 100 to aid pushing the ball and tube into the duct. With the ball 100 inserted a few feet into the duct, the air compressor is pressurized to the desired operating pressure and the proximal end 82 of delivery tube 80 is connected to the air compressor. This pressurizes the tube 80 and pressurized air is immediately expelled through the outlet orifices in atomizing ball 100. There are twelve outlet orifices 110 and 112 in the ball 100 shown in FIGS. 6 and 7, six of which are angled back toward the inlet 102 and thus the register 162*f* as the ball 100 and tube 80 are snaked into the branch duct 160*f*. As such, the high-pressure air that is expelled through the six backward oriented outlet orifices (i.e., orifices 110) propel the atomizing ball 100 and the trailing delivery tube 80 along the branch duct 160*f*, with assistance provided by the technician pushing the delivery tube into the branch duct, and into the main duct 156. Although the air expelled through orifices 112 is in an angularly opposed direction relative to the air expelled through orifices 110, the combination of the air expelled from the six orifices 110 and the pushing force provided by the technician overcomes the force of the air expelled through orifices 112. As such, the ball 100 is easily jetted along main duct 156 to the primary T-branch 164 shown in FIG. 9. Depending upon the design of the various ducts, the ball 100 may be propelled/pushed even around tight corners. At this point with the atomizing ball 100 in the desired location in the duct system, the air compressor is disconnected from delivery tube 80.

When the ball 100 is in the desired position, regardless of which method described above is used to deliver the ball to that position, the proximal end of delivery tube 80 is next attached to outlet 36 of trigger head assembly 26 of canister 20 (which has been filled with sanitizing fluid and attached to the trigger head). The pressurized line from the air compressor is then attached to canister 20 at quick connect fitting 22. Trigger 26 may then be actuated.

As soon as the trigger 26 is actuated, the headspace 50 above liquid level 48 in canister 20 is pressurized. This creates a high pressure in the headspace, which drives liquid upwardly in passageway 52 of straw 44. As detailed earlier, the liquid is at least partially atomized at venturi 58 and the mist is pushed through delivery tube 80 and out of the twelve outlet orifices in the atomizing ball 100. The size of the orifice openings causes the already at least partially atomized sanitizing fluid to become completely atomized into a very fine mist that is ejected at a high velocity out of the orifices. The mist is thoroughly applied to the interior surfaces of the duct with very complete coverage.

As would be expected, the jetting of atomized sanitizing fluid through the orifices may tend to drive ball 100 away from its origin point at register 162*f*. Therefore, the operator slowly pulls on delivery tube 80 to pull ball 100 back through the main duct 156 and then through branch duct 162*f* as the trigger 32 remains depressed. As the ball is withdrawn, the fine droplets of sanitizing fluid expelled out of the outlet orifices 110 and 112 completely and thoroughly coat the interior surfaces of the duct with the mist. The speed at which the tube is withdrawn affects the amount of sanitizing liquid applied to the ducts. And as noted above, the trigger 32 is a variable opening trigger—the further that the trigger is moved from closed toward fully open, the more sanitizing fluid that flows through the system.

When the atomizing ball 100 reaches register 162*f* the trigger 32 is released and the flow of sanitizing fluid immediately stops—the headspace 50 is immediately depressurized. The operator may then remove ball 100 and delivery tube 80 and move to another register to sanitize the next duct or ducts. It will be appreciated that the operator will be required to work his or her way around the structure in order to sanitize all of the various ducts.

Using the apparatus and method described above and as shown in the drawings, the entire duct system of a structure is very thoroughly sanitized and the atomized or misted sanitizing fluid is not expelled into the living space. If desired, during sanitization of one set of ducts, other registers in the structure may be closed to insure that sanitizer does not flow into the living space. In addition, it will be recognized that use of the invention is not limited to sanitizing fluids applied to HVAC ducts, but may be used with other fluids that are to be applied to tubing, such as sealers, deodorizers, etc. applied to virtually any type of elongate enclosed space.

Figure 10:
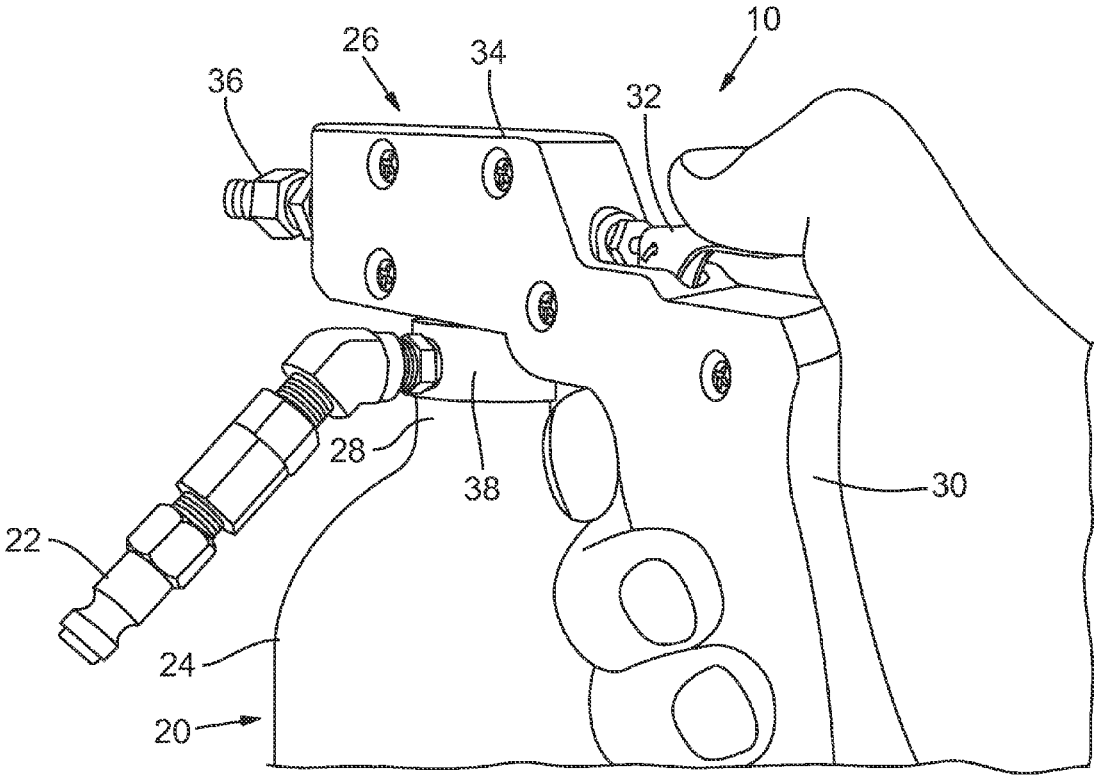
FIG. 10 is a perspective view of the canister according to the present invention illustrating use of the apparatus.

Finally, FIG. 10 illustrates the manner in which an operator holds canister 20 to operate trigger 32 to operate the apparatus 10. The canister and trigger head assembly 26 and trigger 30 are ergonomically designed to make the system easy to handle While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. Apparatus for applying fluid in the form of a mist to a duct, comprising:

a canister for containing a reservoir of fluid;

a tube having a proximal end releasably connected to said canister and an atomizing ball on a distal end thereof;

said atomizing ball having an inlet opening for receiving fluid from said tube, and chamber fluidly communicating with the inlet opening, and first and second sets of plural orifices, each of the plural orifices fluidly communicating with said chamber and defining a fluid flow outlet from said chamber and each of the plural orifices in the first set angularly oriented in one direction and each of said plural orifices in the second set angularly oriented in a different direction from the one direction.

2. The apparatus according to claim 1 wherein all of said plural orifices are angularly oriented relative to said inlet opening.

3. The apparatus according to claim 2 wherein all of said plural orifices are angled relative to said inlet opening at an angle between about 20 and 45 degrees.

4. The apparatus according to claim 3 wherein said atomizing ball comprises twelve orifices, six of which define the first set of orifices and the remaining six define the second set of orifices.

5. The apparatus according to claim 1 wherein said canister further comprises a head having a trigger and a straw depending from said head into said fluid, said straw having a fluid passageway therethrough, and a fluid path from said fluid passageway to said tube.

6. The apparatus according to claim 5 wherein said canister includes a headspace above fluid contained therein and said straw includes a venturi tube in said headspace that communicates with said fluid passageway.

7. The apparatus according to claim 6 wherein said canister further comprises a port for attaching a compressor to said canister.

8. The apparatus according to claim 7 in which the inlet opening defines an axis and wherein each orifice is at a fixed location on the atomizing ball and wherein in the first set of plural orifices is radially spaced around the axis and equally separated from adjacent orifices in the first set of plural orifices.

9. The apparatus according to claim 8 and wherein each orifice in the second set of plural orifices is radially spaced around the axis and equally separated from adjacent orifices in the second set of plural orifices.

10. The apparatus according to claim 9 wherein each orifice in the first set of orifices is radially offset relative to each orifice in the second set of orifices.

11. A method of applying fluid to ducts, comprising the steps of:

a) extending a tube into a duct, said tube having an atomizing ball attached to a distal end thereof and attached at a proximal end to a canister defining a reservoir of fluid, wherein said atomizing ball is provided with plural outlet orifices arranged in an annular array in which a first group of plural orifices define a first fluid flow path from said atomizing ball in which the first fluid flow path is angularly oriented in first direction and in which a second group of plural orifices define a second fluid flow path from said atomizing ball in which the second fluid flow path is angularly oriented in a different direction from the first direction;

b) filling said canister with a quantity of fluid;

c) pressurizing said canister;

d) causing said fluid to flow from said reservoir through said tube and to flow out of said first and second fluid flow paths in a misted condition; and e) while said fluid is flowing out of said first and second fluid flow paths, withdrawing said tube and atomizing ball from said duct.

12. The method according to claim 11 wherein the step of extending said tube into said duct includes the step of disconnecting said proximal end of said tube from said canister and attaching said proximal end to a compressor so that pressurized air flows from said plural orifices while said tube is being extended into said duct.

13. The method according to claim 12 wherein in said duct is in a structure having plural ducts and at least some of said ducts include register grates, and including the step of closing at least some of said register grates.

14. The method according to claim 11 wherein the step of pressurizing said canister includes the step of pressurizing a headspace in the canister above said fluid contained therein.

15. The method according to claim 14 including the step of causing said fluid in said reservoir to flow in a fluid passageway in a tube extending into said fluid so that said fluid passes a venturi in said tube and wherein said venture is in said headspace.

16. The method according to claim 15 wherein said fluid is at least partly converted to fine droplets as said fluid passes said venturi.

17. The method according to claim 16 wherein said fluid is further converted to fine droplets as it flows out of said plural orifices.

18. Apparatus for applying fluid in the form of a mist to a duct, comprising:

a canister for containing a reservoir of fluid and defining a headspace above fluid in said canister;

a head assembly attached to said canister and having a fluid outlet, a tube extending into said reservoir and defining a fluid pathway from said reservoir to said fluid outlet, a compressed air inlet and a trigger operable to open and close said fluid pathway;

a delivery tube having a proximal end releasably connected to said fluid outlet;

a misting ball on a distal end of said delivery tube, said misting ball having an inlet opening for receiving fluid from said delivery tube and plural orifices defined by a first set of plural orifices and a second set of plural orifices, each of said orifices in the first and second sets of plural orifices defining an outlet from said misting ball with each outlet having a fixed position; and wherein, each orifice is radially located around an axis defined by the inlet opening and each orifice is radially staggered from adjacent orifices.

19. The apparatus according to claim 18 wherein the tube extending into said reservoir includes a venturi opening in said headspace.

20. The apparatus according to claim 19 wherein the venturi fluidly communicates with said fluid pathway.

* * * * *